US005167052A

United States Patent [19]

Aoki et al.

[11] Patent Number: 5,167,052

[45] Date of Patent: Dec. 1, 1992

[54] LOCKABLE SLIDER FOR A SLIDE FASTENER

[75] Inventors: Tsunetaka Aoki, Toyama; Shunji Akashi, Kurobe, both of Japan

[73] Assignee: Yoshida Kogyo K. K., Tokyo, Japan

[21] Appl. No.: 813,645

[22] Filed: Dec. 27, 1991

[30] Foreign Application Priority Data

Dec. 28, 1990 [JP] Japan ..... 2-416190

[51] Int. Cl.[5] ..... A44B 19/00; E05B 67/00

[52] U.S. Cl. ..... 24/421; 24/418; 70/68

[58] Field of Search ..... 24/421, 419, 429, 418, 24/422; 70/68

[56] References Cited

U.S. PATENT DOCUMENTS

| | | | |
|---|---|---|---|
| 2,166,581 | 7/1939 | Carlile | 70/68 |
| 3,270,535 | 9/1966 | Fukuroi | 70/68 |
| 4,015,457 | 4/1977 | Fukuroi | 70/68 |
| 4,271,689 | 6/1981 | Kasai | 70/68 |
| 4,287,646 | 9/1981 | Kanzaka | 24/205.14 R |
| 4,438,550 | 3/1984 | Oda | 70/57 |
| 4,514,884 | 5/1985 | Kaneko | 70/68 |
| 4,884,419 | 12/1989 | Ling | 70/68 |
| 4,951,485 | 8/1990 | Wake | 70/68 |
| 4,976,014 | 12/1990 | Akashi et al. | 24/421 |

FOREIGN PATENT DOCUMENTS

| | | |
|---|---|---|
| 467967 | 1/1947 | Belgium . |
| 0274105 | 12/1987 | European Pat. Off. . |
| 0366022 | 10/1989 | European Pat. Off. . |
| 56-37607 | 9/1981 | Japan . |
| 62-32415 | 8/1987 | Japan . |
| 238508 | 11/1945 | Switzerland . |
| 1368778 | 10/1974 | United Kingdom . |

*Primary Examiner*—Victor N. Sakran

*Attorney, Agent, or Firm*—Hill, Van Santen, Steadman & Simpson

[57] ABSTRACT

A lockable slider for a slide fastener comprises a slider body having a guide channel, a cover member having an elongate aperture, a locking member, and a switching means movable in the aperture between a first position in which to advance the locking member into the guide channel and a second position in which to retract the locking member away from the guide channel.

6 Claims, 7 Drawing Sheets

LOCKABLE SLIDER FOR A SLIDE FASTENER

BACKGROUND OF THE INVENTION

1. Field of the Invention

This invention relates to slide fasteners and more particularly a slider therefor which is switchable between locked and unlocked positions.

2. Prior Art

There are known various types of the so-called lockable sliders, a typical example of which is a slider having a key lock mechanism as disclosed for instance in Japanese Utility Model Publication No. 62-32415 and another example is a slider having a stopper means operatively associated with a slider pull tab as disclosed for instance in Japanese Utility Model Publication No. 56-37607. Most key-lock sliders are designed with the use of a key to keep the slider in locked position in which a locking prong extends into a guide channel for the passage of coupling element rows on slide fastener stringers and release the slider into unlocked position in which the locking prong is freely movable into and out of the guide channel, or alternatively switch the key to hold the locking prong retracted away from the guide channel. Sliders of the other type are constructed such that a stopper means often in the form of a locking prong integral with the pull tab is retracted from the guide channel by pulling the pull tab in one or the other direction and brought into engagement in between the coupling elements by flipping the pull tab flat against the slider body to prevent unintentional movement of the slider along the slide fastener. Since the latter type of lockable slider is easily released from its locked position by manipulating the pull tab, the user would often unconsciously leave his garment or bag with the slider unlocked thereon, posing a theft or other security problem. Whereas, the key locking type of slider literally requires the user to carry with him a key in which instance such key is liable to get lost. It would also be embarrassing to put a key on a person. Furthermore, keys are by nature tedious to handle and hence would often be left unused.

SUMMARY OF THE INVENTION

With the foregoing problems of the prior art in view, the present invention seeks to provide an improved slider for a slide fastener which incorporates means of switching the slider from locked position to unlocked position, or vice versa, with utmost ease and without the use of a key.

According to the invention, there is provided a lockable slider for a slide fastener including a pair of interengaging element rows to be coupled and uncoupled by the lockable slider, the lockable slider comprising a slider body including an upper wing member and a lower wing member joined at one end of the slider body by a connecting neck so as to define therebetween a generally Y-shaped guide channel, a cover member mounted on and jointly defining with the upper wing member an elongate aperture, a pull tab pivotably connected to the cover member, a locking member having a locking prong at one of its ends and a switching means movable in the elongate aperture between a first position in which to cause the locking prong to advance into the guide channel and a second position in which to cause the locking prong to retract from the guide channel.

The above features and advantages of the invention will be apparent from the following detailed description taken in conjunction with the accompanying drawings.

DESCRIPTION OF THE DRAWINGS

Like reference numerals refer to like or corresponding parts throughout the several views.

DETAILED DESCRIPTION OF THE INVENTION

Figure 1:
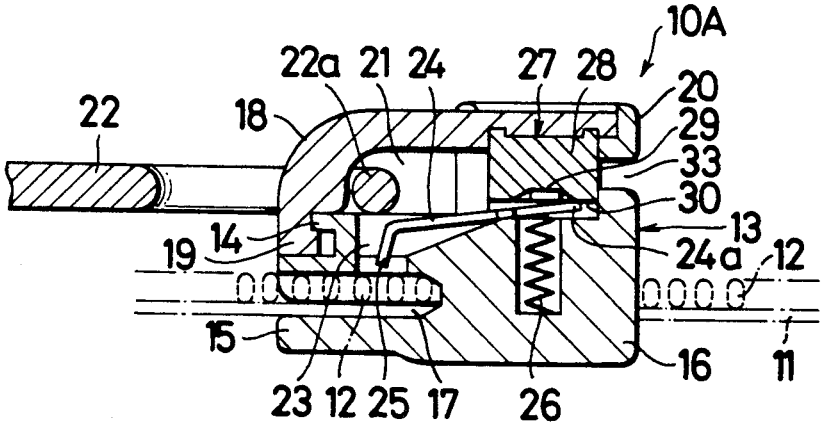
FIG. 1 is a longitudinal cross-sectional view of a lockable slider according to a first embodiment shown mounted on a slide fastener stringer and disposed in unlocked position relative to the fastener stringer.
Figure 2:
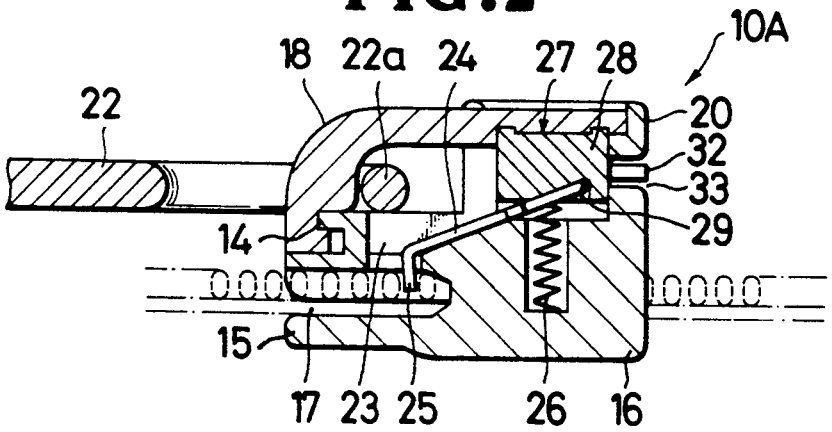
FIG. 2 is a view similar to FIG. 1 but showing the slider in locked position.
Figure 3:
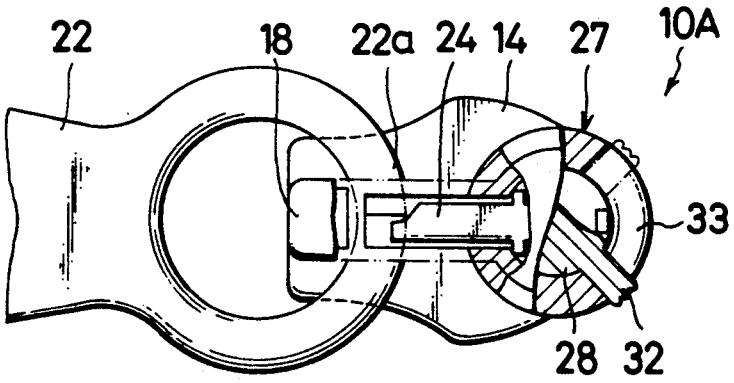
FIG. 3 is a top plan, partially broken away, view of the lockable slider of FIG. 1.

FIGS. 1 through 6 inclusive illustrate a lockable slider 10A according to a first embodiment of the invention. The slider 10A is reciprocally movable along a pair of fastener stringers 11 to take rows of coupling elements 12 thereon into and out of engagement with each other. The slider 10A comprises a slider body 13 including an upper wing member 14 and a lower wing member 15 joined at one end of the slider body 13 by a connecting neck or diamond 16 so as to define therebetween a generally Y-shaped guide channel 17 for the passage therethrough of the stringers 11 as shown in FIGS. 1 and 2. A cover member or trunnion 18 includes an elongate rectangular bar 19 whose one end is secured to a rear end of the upper wing member 14 and a circular hub 20 connected to the other end of the bar 19. The cover member 18 and the upper wing member 14 jointly define therebetween an elongate aperture 21 in which a pull tab 22 is pivotably mounted. The upper wing member 14 has a guide through opening 23 communicating with the guide channel 17 and the elongate aperture 21.

A locking member 24 having at one of its ends a downwardly directed locking prong 25 is vertically movably supported on the upper wing member 14 and normally biased upwardly at the opposite end 24*a* by the action of a spring member 26 so as to urge the locking prong 25 through the opening 23 into the guide channel 17 as shown in FIG. 2.

A switching means 27 in the form of a collet 28 is mounted in place between the upper wing member 14 and the cover member 18 and has a central locking groove 29 defined by a peripheral ridge 30 extending circumferentially around the lower surface of the collet 28 as shown in FIGS. 1 and 2. As better shown in FIG. 5, the collet 28 has a plurality of lugs 31 extending in spaced relation to each other and projecting upwardly from the upper surface of the collet 28 and a radially outwardly projecting actuating member 32 which is exposed to view through an arcuate guide slot 33 formed between the hub 20 and the upper wing member 14.

Figure 6:
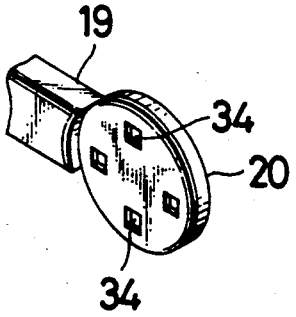
FIG. 6 is a perspective view of part of a cover member for the slider FIG. 1.

The circular hub 20 is provided, as shown in FIG. 6, with a plurality of dents 34 formed in its lower surface in spaced relation to each other for engagement with the lugs 31 of the collet 28. The collet 28 is disposed rotatable by the actuating member 32 which is movable through the arcuate guide slot 33 in a plane parallel to the general plane of the slider body 13, the arrangement being that rotating the collet 28 in one direction will cause the opposite end 24*a* of the locking member 24 to ride on the peripheral ridge 30 of the collet 28 against the tension of the sprig 26, in which position the locking prong 25 is lifted or retracted away from the guide channel 17, allowing the slider 10A to move freely along the stringers 11 by manipulation of the pull tab 22 as shown in FIG. 1, and rotating the collet 28 in the opposite direction will cause the opposite end 24*a* of the locking member 24 to disengage from the ridge 30 and fall into the locking groove 29 of the collet 28 under the tension of the spring 26, in which position the locking prong 25 has moved into the guide channel 17 to engage with the coupling elements 12 thereby locking the slider 10A against sliding movement as shown in FIG. 2.

Figure 7:
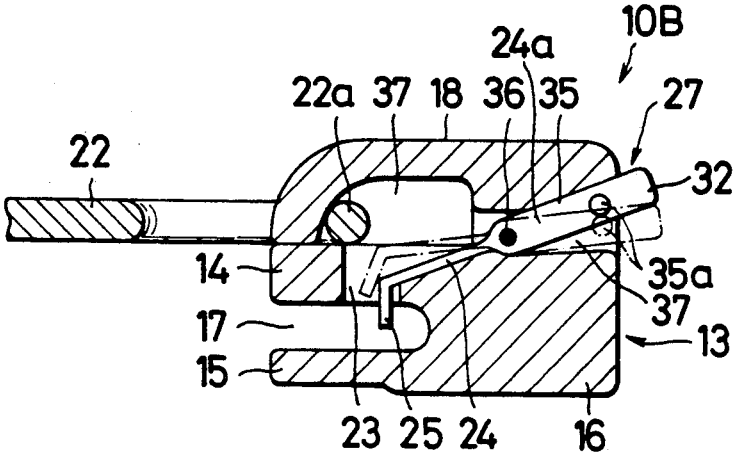
FIG. 7 is a longitudinal cross-sectional view of a lockable slider according to a second embodiment of the invention.
Figure 8:
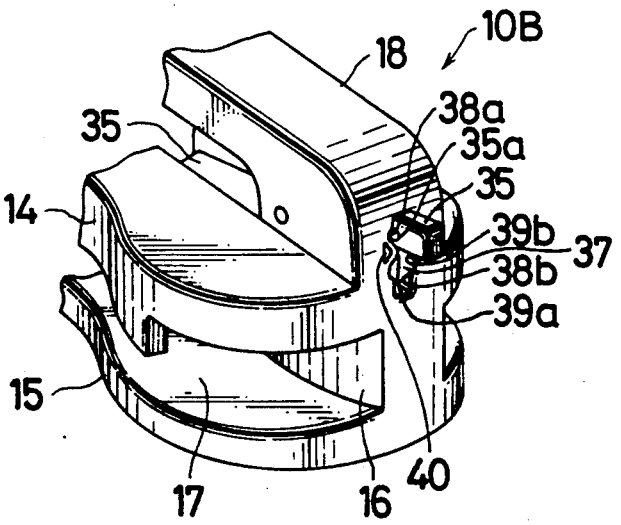
FIG. 8 is a perspective view of the slider of FIG. 7.

FIGS. 7 and 8 show a lockable slider 10B according to a second embodiment of the invention in which the switching means 27 is in the form of a lever 35 integral with the locking member 24. The lever 35 has one of its ends connected to the opposite end 24*a* of the locking member 24 and is pivotable about a pin 36 extending transversely of the slider body 13. An elongate opening 37 extends longitudinally of the cover member 18 in communication with a pair of upper and lower arcuately recessed inner wall portions 38*a* and 38*b* at the front end of the cover member 18 which are demarcated by a pair of opposed bulged inner wall portions 39*a* and 39*b* of the cover member 18. The lever 35 is received in the opening 37 to be pivotable in a plane perpendicular to the general plane of the slider body 13 switchably between the upper and lower recessed inner wall portions 38*a* and 38*b*. The lever 35 has a pair of lateral arcuate projections 35*a* dimensioned to fit snugly in the corresponding recessed wall portions 38*a* and 38*b* of the cover member 18. To provide smooth pivotal movement of the lever 35 between the recessed wall portions 38*a* and 38*b*, there are formed a pair of pores 40 on opposite sides of the bulged inner wall portions 39*a* and 39*b* of the cover member 18, which pores 40 serve to allow the lever 35 to resiliently pass through the bulged wall portions 39*a* and 39*b*. Switching the lever 35 into the upper recessed wall portion 38*a* will cause the locking prong 25 to move into the guide channel 17 as indicated by the solid line in FIG. 7, and switching the lever 35 conversely into the lower recessed wall portion 38*b* will cause the locking prong 25 to retract from the guide channel 17 as indicated by the phantom line in FIG. 7.

Figure 9:
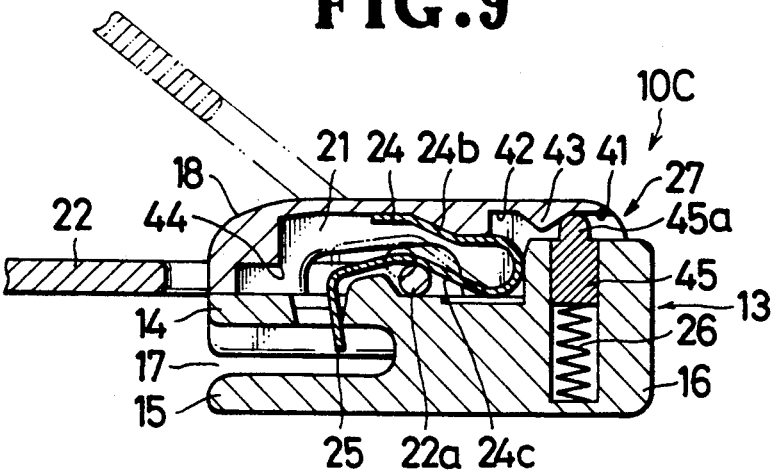
FIG. 9 is a longitudinal cross-sectional view of a lockable slider according to a third embodiment of the invention shown in unlocked position (phantom line)
Figure 10:
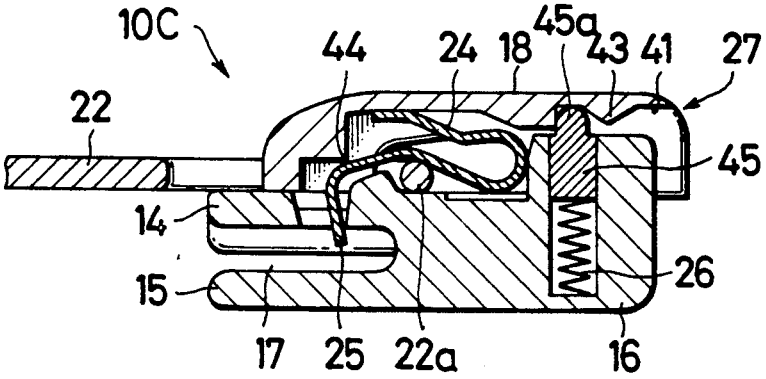
FIG. 10 is a view similar to FIG. 9 but showing the slider in locked position.
Figure 11:
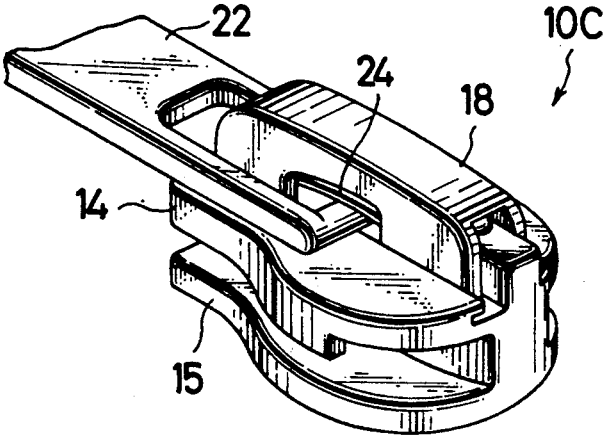
FIG. 11 is a perspective view of the slider of FIG. 9.

FIGS. 9–11 inclusive illustrate a lockable slider 10C according to a third embodiment of the invention. The switching means 27 is embodied in a cover member 18 which is mounted on and longitudinally reciprocally slidable relative to the upper wing member 14 of the slider body 13. The inner wall of the cover member 18 is polygonal in configuration, including at its forward end a first locking recess 41, a second locking recess 42 separated therefrom by a downwardly projecting ridge 43 and at its rearward end a locking ledge 44. A locking member 24 in the form of a leaf spring is looped to provide an upper engaging portion 24*b* and a lower engaging portion 24*c* which are resiliently held in abutting engagement with the cover member 18 and the upper wing member 14, respectively. A locking prong 24 extends downwardly integrally from the lower engaging portion 24*c* of the locking member 18. A pull tab 22 has its pintle portion 22*a* disposed in between the lower engaging portion 24*c* of the locking member 24 and the upper wing member 14. Lifting the pull tab 22 as indicated by the phantom line in FIG. 9 will cause the locking prong 25 to retract away from the guide channel 17, and flipping the pull tab 22 flat against the slider body 13 will allow the locking prong 25 to enter into the guide channel 17 by the resilient force of the locking member 24 as shown in FIG. 10 in a manner well known in connection with a conventional automatic lock slider.

Designated at 45 is a locking tab disposed between the cover member 18 and a spring member 26 supported in the diamond 16. The locking tab 45 is normally biased upwardly toward the cover member 18 with its head 45*a* lockable in either of the two locking recesses 41 and 42 in the cover member 18 as the latter is moved reciprocally back and forth relative to the slider body 13. Moving the cover member 18 forwardly of the slider body 13 will bring the head 45*a* of the locking tab 45 into registery with the second locking recess 42 of the cover member 18 to retain the locking prong 25 in the guide channel 17 with the lower engaging portion 24*c* of the locking member 24 held in abutting relation to the locking ledge 44 of the cover member 18 as shown in FIG. 10. Moving the cover member 18 backwardly of the slider body 13 will shift the head 45*a* of the locking tab 45 over to the first locking recess 41, in which position the locking member 24 is released from the locking ledge 44 and is ready for manipulation by the pull tab 22 to lift the locking prong 25 from the guide channel 17 as shown in FIG. 9.

Figure 12:
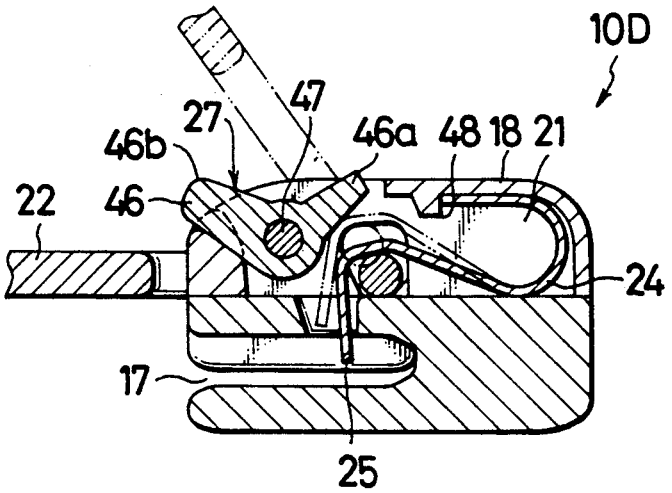
FIG. 12 is a longitudinal cross-sectional view of a lockable slider according to a fourth embodiment of the invention shown in unlocked position (phantom line)
Figure 13:
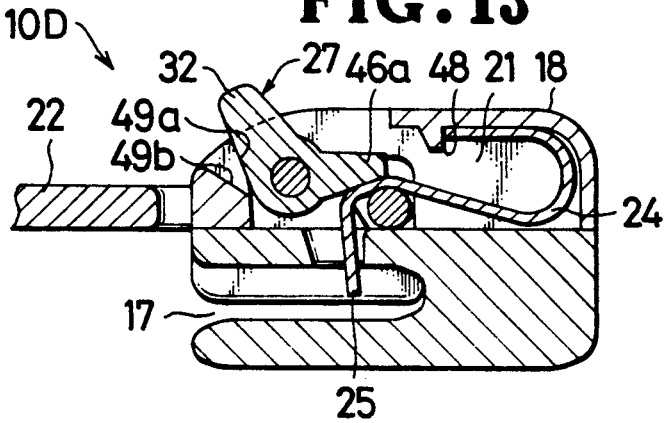
FIG. 13 is a view similar to FIG. 12 but showing the slider in locked position.
Figure 14:
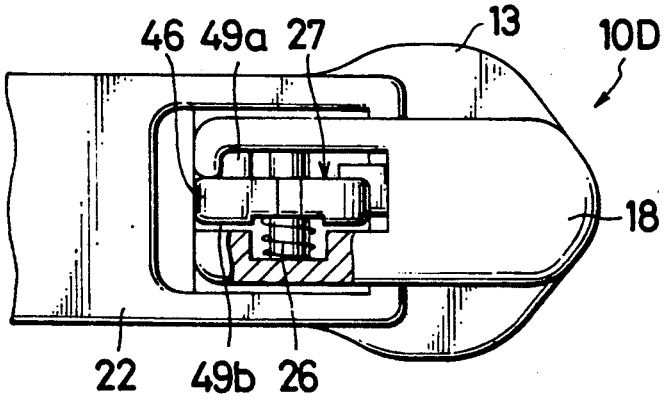
FIG. 14 is a top plan view of the slider of FIG. 12.

FIGS. 12–14 inclusive illustrate a lockable slider 10D according to a fourth embodiment of the invention. The switching means 27 is embodied in a locking tumbler 46 having a first arm 46*a* and a second arm 46*b* and pivotably connected by a transversely extending pin 47 to a cover member 18. A spring member 26 is provided for normally biasing the locking tumbler 46 to move transversely axially of the pin 47 toward one side of the slider body 13 as better shown in FIG. 14. A locking member 24 is similar in construction to the locking member 24 shown in FIGS. 9 and 10 but has its end opposite to the locking prong 25 anchored at a projection 48 formed in the inner wall of the cover member 18. The second arm 46b of the locking tumbler 46 is exposed to view beyond the cover member 18 and arranged by pivotal movement to come into abutting engagement with a first stepped inclined locking surface 49a and a second stepped inclined locking surface 49b respectively formed in the rear end of the cover member 18 as shown in FIGS. 12 and 13. The first locking surface 49a lies at a predetermined level above the second locking surface 49b such that rotating the locking tumbler 46 clockwise will bring its second arm 46b into abutting engagement with the first locking surface 49a, in which position the first arm 46a urges the locking prong 25 into the guide channel 17 as shown in FIG. 13, while rotating the locking tumbler 46 counterclockwise (after moving the same transversely against the tension of the spring 26) will shift the second arm 46b into abutting engagement with the second locking surface 49b, in which position the first arm 46a of the tumbler 46 releases the locking prong 25 to retract from the guide channel 17 as shown in FIG. 12.

Figure 15:
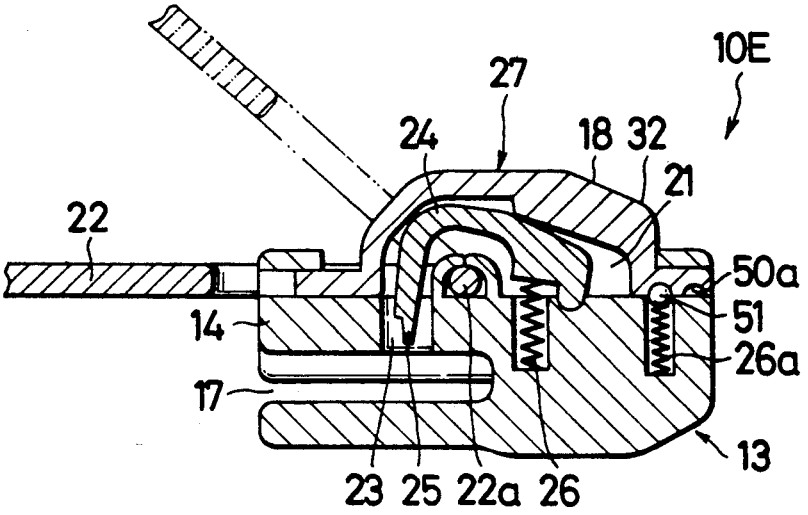
FIG. 15 is a longitudinal cross-sectional view of a lockable slider according to a fifth embodiment of the invention shown in unlocked position.
Figure 16:
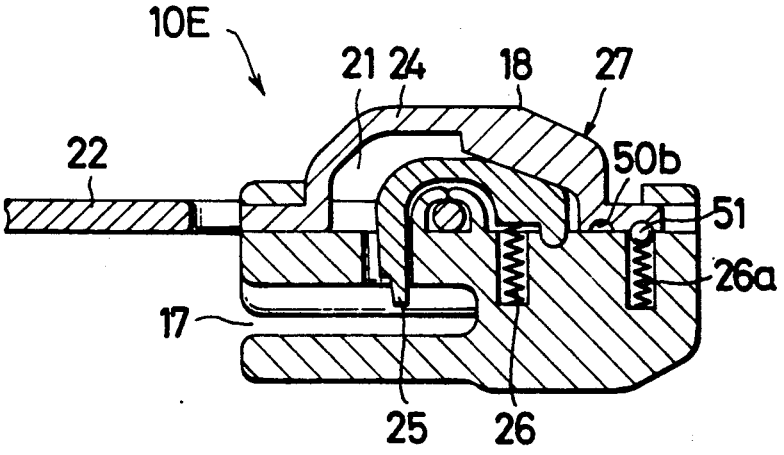
FIG. 16 is a view similar to FIG. 15 but showing the slider in locked position.

FIGS. 15 and 16 illustrate a lockable slider 10E according to a fifth embodiment of the invention. The switching means 27 is embodied in a cover member 18 and is essentially similar to that which is shown in FIGS. 9-11 in that the cover member 18 is longitudinally movable in sliding relation to the slider body 13 between two selected operative positions. The cover member 18 has a first arcuate dent 50a and a second arcuate dent 50b spaced apart longitudinally of the slider body 13 and facing toward the upper wing member 14 at one or front end of the slider body 13. A second spring 26a is provided with a ball 51 supported thereon at the front end of the slider body 13, which ball 51 alternately engages either of the two arcuate dents 50a and 50b under the tension of the spring 26a as the cover member 18 is moved back and forth relative to the slider body 13.

A locking member 24 is supported at one end on a spring member 26 which normally urges the locking member 24 against the inner wall of the cover member 18. Moving the cover member 18 backwardly of the slider body 13 will register and lock the first dent 50a with the ball 51, in which position the locking member 24 descends against the tension of the spring member 26 with its locking prong 25 entering into the guide channel 17 as shown in FIG. 16. Moving the cover member 18 forwardly of the slider body 13 will shift the second dent 50b into locking engagement with the ball 51, in which position the locking member 24 is bounced back upwardly by the action of the spring member 26 with its locking prong 25 lifted from the guide channel 17 as shown in FIG. 15.

Figure 17:
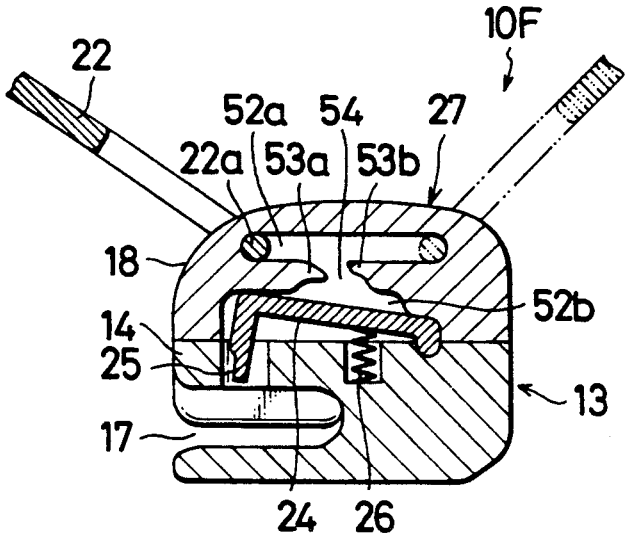
FIG. 17 is a longitudinal cross-sectional view of a lockable slider according to a sixth embodiment of the invention shown in unlocked position.
Figure 18:
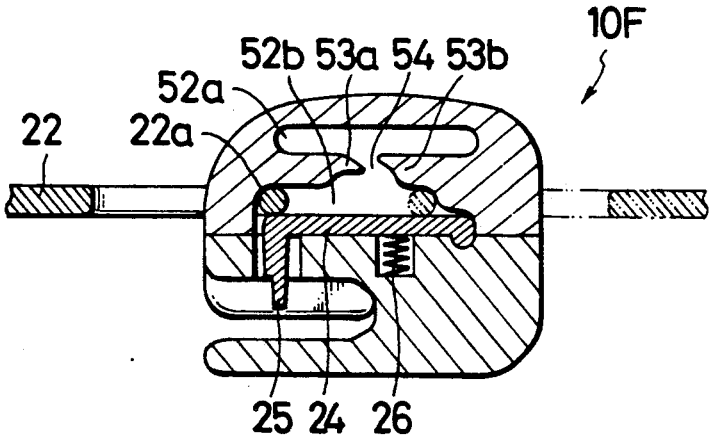
FIG. 18 is a view similar to FIG. 17 but showing the slider in locked position.

FIGS. 17 and 18 illustrate a lockable slider 10F according to a sixth embodiment of the invention. The switching means 27 is further embodied in a cover member 18 which is provided internally with a first or upper elongate aperture 52a and a second or lower elongate aperture 52b separated therefrom by a pair of opposed inwardly projecting ledges 53a and 53b defining therebetween a central opening 54 dimensioned to allow the passage therethrough of the pintle 22a of the pull tab 22 selectively into and out of the upper and lower apertures 52a and 52b. A locking member 24 has one end movably supported on the upper wing member 14 of the slider body 13 and connected to a spring member 26 which normally urges the locking prong 25 upwardly away from the guide channel 17. The pull tab 22 is manipulated in a manner that its pintle 22a is brought into the second aperture 52b between the ledge 53a and the locking member 24 immediately above the locking prong 25 and the pull tab 22 is laid flat against the slider body 13 as shown in FIG. 18, in which position the locking prong 25 is forced down into the guide channel 17 against the tension of the spring member 26 thereby locking the slider 10F against movement. Bringing the pintle 22a of the pull tab 22 up through the opening 54 into the first aperture 52a will release the locking member 24, when the locking prong 25 is lifted from the guide channel 17 and borne against the ledge 53a of the cover member 18 as shown in FIG. 17, in which position the slider 10F is ready for sliding movement by the pull tab 22.

Various changes and modifications may be made in the specific form and construction herein described and illustrated, without departing from the scope of the appended claims.

Figure 4:
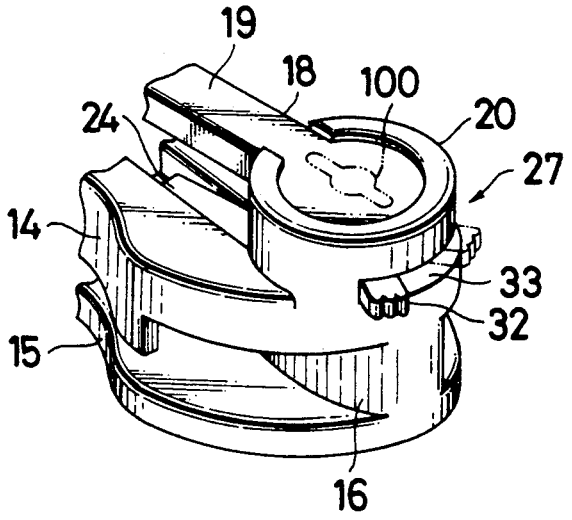
FIG. 4 is a perspective, partially broken away, view of the slider of 1.
Figure 5:
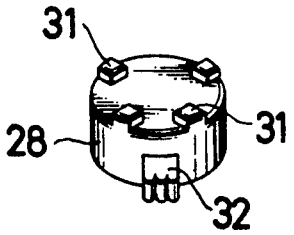
FIG. 5 is a perspective view of an switching means constituting a part of the slider of FIG. 1.

As for an example, such a mock key hole designated at 100 and indicated by the phantom line in FIG. 4 may be provided in the upper surface of the hub 20 that may serve to avert theft. Also, the actuating member 32 of the switching means 27 better shown in FIG. 4 may be shortened to be concealed from view.

What is claimed is:

1. A lockable slider for a slide fastener including a pair of interengaging element rows to be coupled and uncoupled by the lockable slider, said lockable slider comprising:

(1) a slider body including an upper wing member and a lower wing member joined at one end of the slider body by a connecting neck so as to define therebetween a generally Y-shaped guide channel;

(2) a cover member mounted on and jointly defining with said upper wing member an elongate aperture;

(3) a pull tab pivotably connected to said cover member;

(4) a locking member having a locking prong at one of its ends; and (5) a switching means movable in said elongate aperture between a first position in which to cause said locking prong to advance into said guide channel and a second position in which to cause said locking prong to retract from said guide channel, said switching means comprising a collet rotatably mounted between said upper wing and said cover member and having a central locking groove defining said first position, a peripheral ridge extending circumferentially around said locking groove and defining said second position, and a radially outwardly projecting lever exposed to view for actuating said collet.

2. A lockable slider for a slide fastener including a pair of interengaging element rows to be coupled and uncoupled by the lockable slider, said lockable slider comprising:

(1) a slider body including an upper wing member and a lower wing member joined at one end of the slider body by a connecting neck so as to define therebetween a generally Y-shaped guide channel;

(2) a cover member mounted on and jointly defining with said upper wing member an elongate aperture;

(3) a pull tab pivotably connected to said cover member;

(4) a locking member having a locking prong at one of its ends; and (5) a switching means movable in said elongate aperture between a first position in which to cause said locking prong to advance into said guide channel and a second position in which to cause said locking prong to retract from said guide channel wherein said cover member is provided at one of its ends with a pair of upper and lower recessed inner wall portions, and said switching means is embodied in the form of a lever formed integral with said locking member and pivotable between said upper and lower recessed inner wall portions.

3. A lockable slider for a slide fastener including a pair of interengaging element rows to be coupled and uncoupled by the lockable slider, said lockable slider comprising:

(1) a slider body including an upper wing member and a lower wing member joined at one end of the slider body by a connecting neck so as to define therebetween a generally Y-shaped guide channel;
(2) a cover member mounted on and jointly defining with said upper wing member an elongate aperture;
(3) a pull tab pivotably connected to said cover member;
(4) a locking member having a locking prong at one of its ends; and
(5) a switching means movable in said elongate aperture between a first position in which to cause said locking prong to advance into said guide channel and a second position in which to cause said locking prong to retract from said guide channel wherein said switching means is embodied in the form of a cover member and a locking tab operatively associated therewith, said cover member being reciprocally movable relative to said upper wing member and having a first locking recess and a second locking recess selectively engageable with said locking tab.

4. A lockable slider for a slide fastener including a pair of interengaging element rows to be coupled and uncoupled by the lockable slider, said lockable slider comprising:

(1) a slider body including an upper wing member and a lower wing member joined at one end of the slider body by a connecting neck so as to define therebetween a generally Y-shaped guide channel;
(2) a cover member mounted on and jointly defining with said upper wing member an elongate aperture;
(3) a pull tab pivotably connected to said cover member;
(4) a locking member having a locking prong at one of its ends; and
(5) a switching means movable in said elongate aperture between a first position in which to cause said locking prong to advance into said guide channel and a second position in which to cause said locking prong to retract from said guide channel wherein said cover member has at one of its ends first and second inclined locking surfaces, and said switching means is embodied in the form of a locking tumbler pivotably connected to said cover member and selectively engageable with said first and second inclined locking surfaces.

5. A lockable slider for a slide fastener including a pair of interengaging element rows to be coupled and uncoupled by the lockable slider, said lockable slider comprising:

(1) a slider body including an upper wing member and a lower wing member joined at one end of the slider body by a connecting neck so a to define therebetween a generally Y-shaped guide channel;
(2) a cover member mounted on and jointly defining with said upper wing member an elongate aperture;
(3) a pull tab pivotably connected to said cover member;
(4) a locking member having a locking prong at one of its ends; and
(5) a switching means movable in said elongate aperture between a first position in which to cause said locking prong to advance into said guide channel and a second position in which to cause said locking prong to retract from said guide channel wherein said switching means is embodied in the form of a cover member and a resiliently supported ball operatively associated therewith, said cover member being reciprocally movable relative to said upper wing member and having first and second arcuate dents selectively engageable with said ball.

6. A lockable slider for a slide fastener including a pair of interengaging element rows to be coupled and uncoupled by the lockable slider, said lockable slider comprising:

(1) a slider body including an upper wing member and a lower wing member joined at one end of the slider body by a connecting neck so as to define therebetween a generally Y-shaped guide channel;
(2) a cover member mounted on and jointly defining with said upper wing member an elongate aperture;
(3) a pull tab pivotably connected to said cover member;
(4) a locking member having a locking prong at one of its ends; and
(5) a switching means movable in said elongate aperture between a first position in which to cause said locking prong to advance into said guide channel and a second position in which to cause said locking prong to retract from said guide channel wherein said switching means is embodied in the form of a cover member and a pull tab operatively associated therewith, said cover member having an upper elongate aperture and a lower elongate aperture separated therefrom by a pair of opposed inwardly projecting ledges defining a central opening for the passage of a portion of said pull tab therethrough selectively into and out of said upper and lower apertures.

* * * * *